US010741156B2

(12) United States Patent
Nomura

(10) Patent No.: US 10,741,156 B2
(45) Date of Patent: Aug. 11, 2020

(54) SOUND PICKUP DEVICE AND OUTPUT METHOD THEREOF

(71) Applicant: Roland Corporation, Shizuoka (JP)

(72) Inventor: Kotaro Nomura, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/246,560

(22) Filed: Jan. 14, 2019

(65) Prior Publication Data

US 2019/0221199 A1 Jul. 18, 2019

(30) Foreign Application Priority Data

Jan. 17, 2018 (JP) ..... 2018-005577

(51) Int. Cl.

*G10H 3/14* (2006.01)
*H04R 1/46* (2006.01)
*H04R 3/00* (2006.01)

(52) U.S. Cl.

CPC ..... *G10H 3/146* (2013.01); *G10H 3/143* (2013.01); *H04R 1/46* (2013.01); *G10H 2220/525* (2013.01); *G10H 2230/275* (2013.01); *H04R 3/00* (2013.01); *H04R 2420/01* (2013.01)

(58) Field of Classification Search

CPC ..... G10H 3/146
USPC ..... 84/730, 742
See application file for complete search history.

(56) References Cited

U.S. PATENT DOCUMENTS 3,551,580 A * 12/1970 Glenn ..... G10H 3/146 84/641
5,036,742 A 8/1991 Youakim
5,293,000 A * 3/1994 Adinolfi ..... G10D 13/024 84/730
5,345,037 A 9/1994 Nordelius
(Continued)

FOREIGN PATENT DOCUMENTS

DE 29506034 8/1995
EP 002613745-0001 1/2015
(Continued)

OTHER PUBLICATIONS

"Search Report of Europe Counterpart Application", dated Jun. 17, 2019, p. 1-p. 10.
(Continued)

*Primary Examiner* — David S Warren
(74) *Attorney, Agent, or Firm* — JCIPRNET

(57) ABSTRACT

A sound pickup device is provided including a clamp part for fastening a hoop of a drum, one case fixed to an outer edge of the drum by fastening the hoop with the clamp part, a first output means detecting vibration of a striking surface of the drum, generating a musical sound signal based on the detected vibration, a second output means detecting a performance sound generated by the vibration of the striking surface, generating a sound pickup signal based on the detected performance sound, a third output means mixing the musical sound signal and the sound pickup signal outputted from the first and second output means, a selection means selecting at least one of the first to third output means for output; and a housing part housing a battery. The first output means, the second output means, the third output means, and the housing part are disposed in the one case.

21 Claims, 5 Drawing Sheets

(56) References Cited

U.S. PATENT DOCUMENTS 5,449,964 A 9/1995 Snyder
5,633,473 A * 5/1997 Mori ..... G10H 3/146 84/625
5,920,026 A * 7/1999 Yoshino ..... G10D 13/024 84/414
6,121,538 A * 9/2000 Yoshino ..... G10D 13/024 84/414
6,271,458 B1 * 8/2001 Yoshino ..... G10H 3/146 84/414
6,525,249 B1 * 2/2003 Suenaga ..... G10D 13/022 84/104
6,756,535 B1 * 6/2004 Yoshino ..... G10D 13/024 84/414
6,784,352 B2 * 8/2004 Suenaga ..... G10D 13/022 84/104
6,794,569 B2 9/2004 Kamijima et al.
6,921,857 B2 * 7/2005 Yoshino ..... G10D 13/024 84/414
7,135,630 B2 * 11/2006 Maruhashi ..... G10D 13/024 84/411 P
7,196,261 B2 * 3/2007 Suenaga ..... G10H 3/146 310/331
7,214,871 B2 5/2007 Hasenmaier
7,385,135 B2 * 6/2008 Yoshino ..... G10D 13/024 84/414
7,408,109 B1 * 8/2008 Freitas ..... G10H 3/12 84/687
7,473,840 B2 * 1/2009 Arimoto ..... G10H 1/06 84/615
7,525,032 B2 * 4/2009 Mishima ..... G10H 1/0008 84/477 R
7,569,758 B2 * 8/2009 Harada ..... G10D 13/024 84/411 M
7,667,130 B2 * 2/2010 Mishima ..... G10H 1/0008 84/464 A
7,772,481 B2 * 8/2010 Aimi ..... G10H 3/146 84/107
7,935,881 B2 * 5/2011 Aimi ..... G10H 3/146 84/104
8,121,300 B1 2/2012 LoDuca et al.
8,563,843 B1 * 10/2013 Shemesh ..... G10H 7/00 84/723
8,729,378 B2 * 5/2014 Ryan ..... G10D 13/06 84/723
8,816,181 B2 * 8/2014 Shemesh ..... G10H 7/00 84/615
8,940,991 B2 * 1/2015 Shemesh ..... G10H 7/00 84/615
9,082,378 B2 * 7/2015 Miyashita ..... G10D 13/065
9,100,743 B2 * 8/2015 Braho ..... H04R 1/1025
9,536,509 B2 1/2017 Esparza
9,591,733 B1 * 3/2017 Koltun ..... H05B 41/44
9,805,703 B2 10/2017 Esparza
9,842,579 B1 * 12/2017 Pelz ..... G10H 3/143
9,947,307 B2 * 4/2018 Takasaki ..... G10D 13/024
10,147,409 B2 * 12/2018 Takasaki ..... G10D 13/024
10,192,534 B2 * 1/2019 Yudasaka ..... G10H 1/0008
2003/0037660 A1 * 2/2003 Suenaga ..... G10D 13/022 84/411 R
2003/0188629 A1 * 10/2003 Suenaga ..... G10H 3/146 84/723
2004/0025663 A1 * 2/2004 Harada ..... G10D 13/024 84/104
2004/0083873 A1 * 5/2004 Yoshino ..... G10D 13/024 84/107
2004/0118269 A1 * 6/2004 Yoshino ..... G10H 3/146 84/723
2004/0134332 A1 7/2004 Kamijima et al.
2005/0223880 A1 * 10/2005 Yoshino ..... G10D 13/024 84/738
2005/0257671 A1 * 11/2005 Aimi ..... G10H 3/146 84/735
2005/0262991 A1 * 12/2005 Arimoto ..... G10H 1/06 84/735
2006/0021495 A1 * 2/2006 Freitas ..... G10H 3/10 84/723
2006/0219092 A1 * 10/2006 Mishima ..... G10H 1/0008 84/724
2008/0034946 A1 * 2/2008 Aimi ..... G10H 3/146 84/604
2009/0000464 A1 * 1/2009 Mishima ..... G10H 1/0008 84/724
2013/0139672 A1 * 6/2013 Ribner ..... G10G 7/02 84/602
2013/0145921 A1 * 6/2013 Ribner ..... G10G 7/02 84/454
2014/0020547 A1 * 1/2014 Shemesh ..... G10H 7/00 84/626
2014/0020548 A1 * 1/2014 Shemesh ..... G10H 7/00 84/626
2014/0208925 A1 * 7/2014 Osborne ..... G10H 3/146 84/725
2014/0208926 A1 7/2014 Shepherd
2014/0260897 A1 * 9/2014 Miyashita ..... G10D 13/065 84/422.3
2014/0301589 A1 10/2014 Greenwood et al.
2016/0093278 A1 3/2016 Esparza
2017/0311066 A1 10/2017 Takehisa et al.
2018/0068646 A1 3/2018 Esparza
2018/0247630 A1 * 8/2018 Suitor ..... G10D 13/024
2018/0330701 A1 * 11/2018 Yudasaka ..... G10H 1/0008

FOREIGN PATENT DOCUMENTS

EP 3236671 10/2017
JP 3772674 5/2006
JP 5245024 7/2013
WO 2018211741 11/2018

OTHER PUBLICATIONS

"Office Action of Europe Counterpart Application", dated Feb. 18, 2020, pp. 1-5.

* cited by examiner

SOUND PICKUP DEVICE AND OUTPUT METHOD THEREOF

CROSS-REFERENCE TO RELATED APPLICATION

This application claims the priority of Japan patent application serial no. 2018-005577, filed on Jan. 17, 2018. The entirety of the above-mentioned patent application is hereby incorporated by reference herein and made a part of this specification.

BACKGROUND

Technical Field

The disclosure relates to a sound pickup device and particularly relates to a sound pickup device capable of increasing variations of musical sound generation.

Description of Related Art

A conventional sound pickup device is equipped with a striking surface sensor that is disposed to face the striking surface of a drum and detects the vibration of the striking surface, and a sound pickup sensor that picks up the actual performance sound (raw sound) generated by the vibration of the striking surface of the drum. For example, Patent Document 1 describes a sound pickup device, in which the striking surface sensor is attached to a sensor attaching part (arm) that extends from a clamp part, which fastens the outer edge of the drum, to the striking surface center side, and the sound pickup sensor (microphone) is attached to an arm that extends upward from the sensor attaching part.

This sound pickup device uses the striking surface sensor as a trigger, and the vibration (performance sound) detected by the sound pickup sensor is outputted to the outside only when the striking surface sensor detects vibration of a predetermined level or more. Therefore, when the sound pickup sensor detects a sound (for example, the performance sound of another instrument) from the surroundings of the drum, it is possible to prevent a signal based on the detection from being outputted to the outside.

RELATED ART

Patent Document

[Patent Document 1] US Patent Laid-Open Publication No. 2014/0301589 (for example, FIG. 3)

However, since only the performance sound picked up by the sound pickup sensor can be outputted to the outside, the conventional technique described above has the problem that it restricts the variations of musical sound generation.

SUMMARY

One of the embodiments of the disclosure provides a sound pickup device capable of increasing the variations of musical sound generation.

A sound pickup device of the disclosure includes a clamp part for fastening a hoop of a drum; one case fixed to an outer edge of the drum by fastening the hoop with the clamp part; a first output means detecting vibration of a striking surface of the drum, generating a musical sound signal based on the detected vibration, and outputting the musical sound signal; a second output means detecting a performance sound generated by the vibration of the striking surface, generating a sound pickup signal based on the detected performance sound, and outputting the sound pickup signal; a third output means mixing the musical sound signal and the sound pickup signal outputted from the first output means and the second output means for output; a selection means selecting at least one of the first output means, the second output means, and the third output means for output; and a housing part housing a battery, wherein the first output means, the second output means, the third output means, and the housing part are disposed in the one case.

BRIEF DESCRIPTION OF THE DRAWINGS

FIG. 1(*b*) is a partially enlarged cross-sectional view of the sound pickup device along the line Ib-Ib of FIG. 1(*a*).

DESCRIPTION OF THE EMBODIMENTS

Exemplary embodiments of the disclosure will be described below with reference to the accompanying drawings. First, a configuration of the sound pickup device 1 will be described with reference to FIG. 1(*a*), FIG. 1(*b*), and FIG. 2.

Figure 1A:
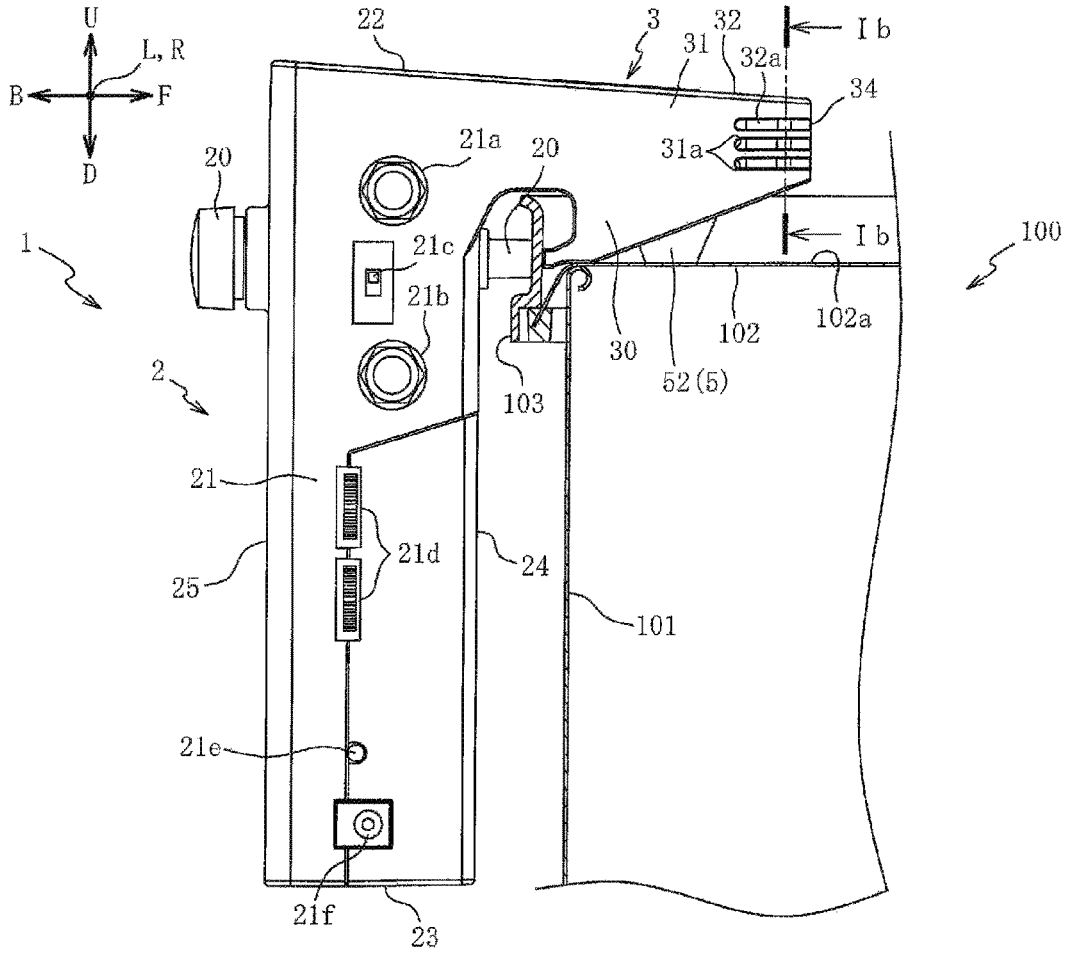
FIG. 1(*a*) is a side view of the sound pickup device in a state of being installed on a drum.
Figure 1B:
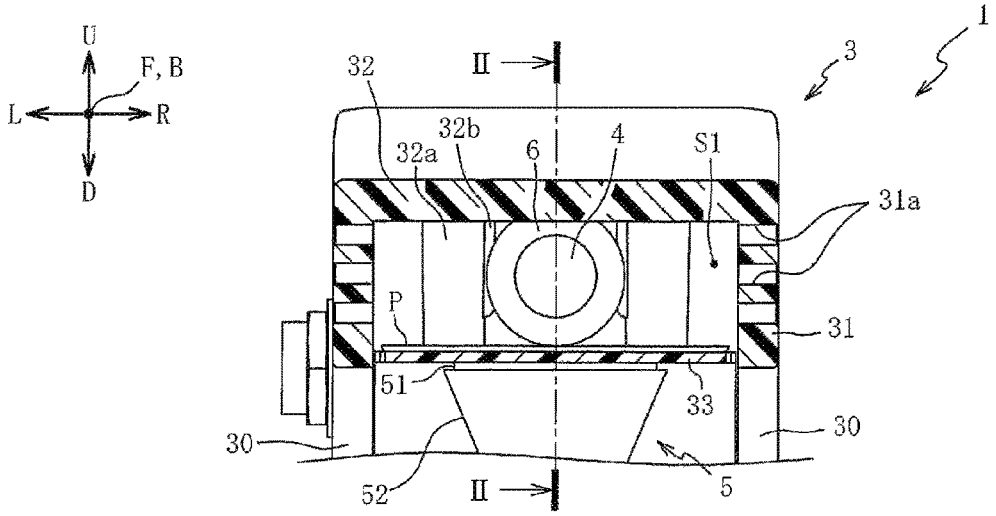
Figure 2:
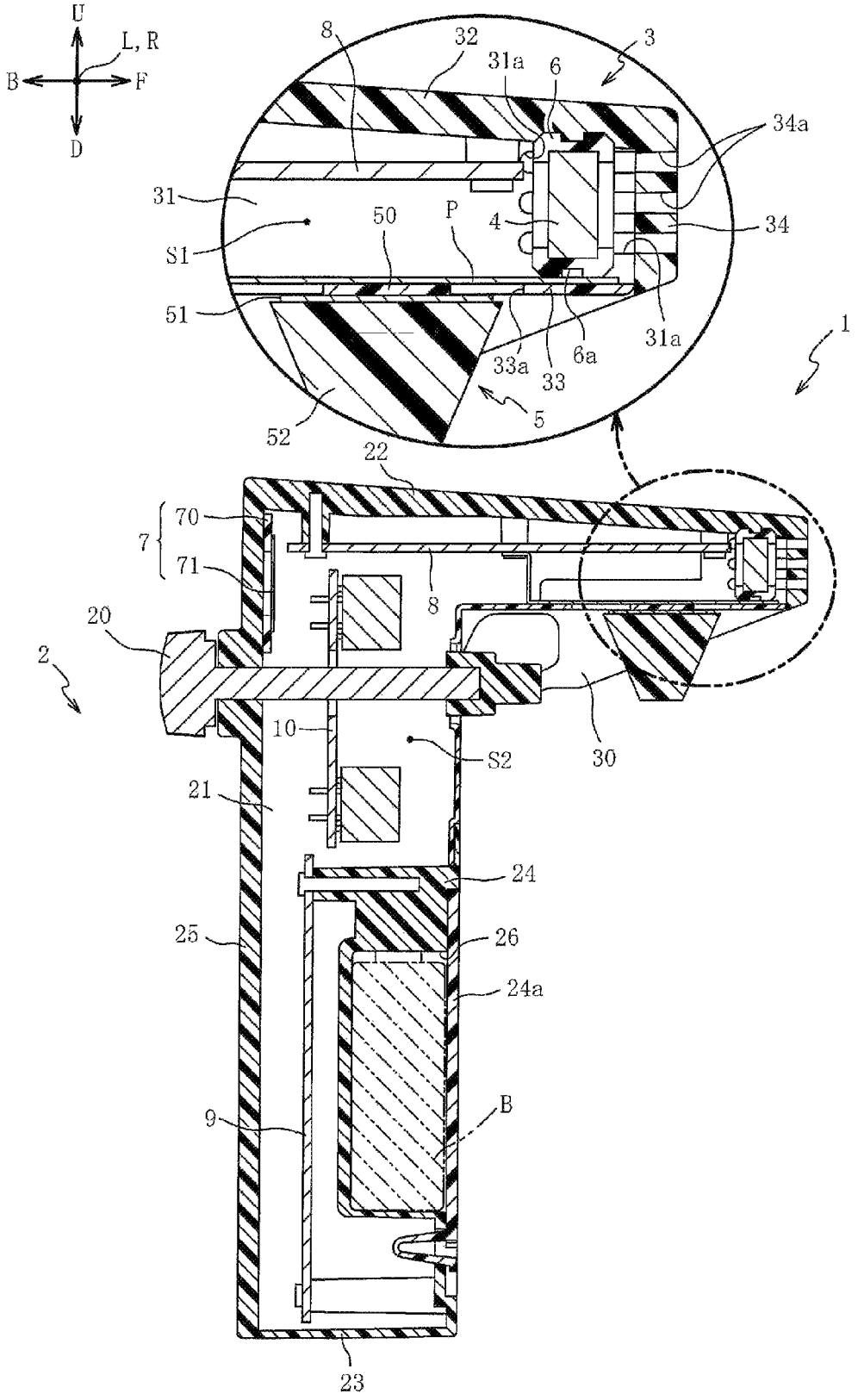
FIG. 2 is a cross-sectional view of the sound pickup device along the line II-II of FIG. 1(*b*).

FIG. 1(*a*) is a side view of the sound pickup device 1 in a state of being installed on a drum 100, and FIG. 1(*b*) is a partially enlarged cross-sectional view of the sound pickup device 1 along the line Ib-Ib of FIG. 1(*a*). FIG. 2 is a cross-sectional view of the sound pickup device 1 along the line II-II of FIG. 1(*b*).

The arrows U-D, L-R, and F-B in FIG. 1(*a*), FIG. 1(*b*), and FIG. 2 respectively indicate the up-down direction, the left-right direction, and the front-back direction of the sound pickup device 1. Further, in the state where the sound pickup device 1 is installed on the drum 100, the up-down direction of the sound pickup device 1 corresponds to the axial direction of a shell 101 (striking surface 102*a*) of the drum 100, the front-back direction of the sound pickup device 1 corresponds to the radial direction of the shell 101 (striking surface 102*a*), and the left-right direction of the sound pickup device 1 corresponds to a direction perpendicular to the axial direction and the radial direction of the shell 101 (striking surface 102*a*), respectively.

As shown in FIG. 1(*a*), the drum 100 with the sound pickup device 1 installed thereon is configured as an acoustic drum. The drum 100 includes the cylindrical shell 101 that has one side opened, a head 102 that is stretched over one side of the shell 101 and has an upper surface configured as the striking surface 102*a*, and a hoop 103 that presses the circumferential edge of the head 102. The hoop 103 is fastened by a fastening bolt 20 of the sound pickup device 1, by which the sound pickup device 1 is fixed to the outer edge of the drum 100. In the following description, the state where the hoop 103 is fastened by the fastening bolt 20 is defined as a "fastening state".

The sound pickup device 1 is a device for detecting the vibration of the striking surface 102*a* of the drum 100 and the performance sound (raw sound) generated by the vibration of the striking surface 102*a*, mixing a musical sound signal based on the vibration and a sound pickup signal based on the performance sound and outputting the mixed signal, or outputting the musical sound signal based on the vibration or the sound pickup signal based on the performance sound to the outside independently.

In the fastening state, the sound pickup device 1 includes a rectangular parallelepiped body part 2 disposed on the outer circumferential side of the shell 101, a sensor attaching part 3 extending from the upper end side of the body part 2 to the center side (the side of the arrow F) of the striking surface 102*a*, and a sound pickup sensor 4 (see FIG. 1(*b*)) and a striking surface sensor 5 attached to the sensor attaching part 3, and the sound pickup device 1 is formed in an L shape in the side view.

The fastening bolt 20 is inserted through the body part 2 along the front-back direction (the direction of the arrow F-B), and the sensor attaching part 3 is connected to the body part 2 on the upper side (the side of the arrow U) of the fastening bolt 20.

The sensor attaching part 3 is formed with a pair of leg parts 30 that protrudes downward (the side of the arrow D) from the lower surface of the sensor attaching part 3 and bends toward the front end of the fastening bolt 20 in the side view (see FIG. 1(*b*) for the leg parts 30 that are provided in pair). The hoop 103 of the drum 100 is fastened by the pair of leg parts 30 and the fastening bolt 20.

The sensor attaching part 3 protrudes to the front side with respect to the position (hereinafter referred to as "fastening position") where the hoop 103 is fastened by the fastening bolt 20 and the leg parts 30, and the sound pickup sensor 4 and the striking surface sensor 5 are attached to the protruding front end side. Therefore, in the fastening state, the sound pickup sensor 4 and the striking surface sensor 5 are located on the center side of the striking surface 102*a* with respect to the fastening position.

By attaching the sound pickup sensor 4 and the striking surface sensor 5 respectively to the sensor attaching part 3 as described above, the sensor attaching part 3 can serve to hold the sound pickup sensor 4 in addition to holding the striking surface sensor 5. That is, it is unnecessary to additionally dispose an arm that extends above the sensor attaching part 3 (for holding the sound pickup sensor 4), so the sound pickup device 1 can be downsized in the up-down direction.

As shown in FIG. 1(*b*), the sensor attaching part 3 includes a pair of side plates 31 opposite to each other in the left-right direction (the direction of the arrow L-R), an upper plate 32 connecting the upper ends of the pair of side plates 31, a lower plate 33 disposed opposite to the lower side of the upper plate 32, and a front plate 34 (see FIG. 1(*a*)) shielding the front end of a space S1 surrounded by the side plates 31, the upper plate 32, and the lower plate 33.

The upper plate 32 has a pair of columnar portions 32*a* extending downward from the lower surface of the upper plate 32, and the sound pickup sensor 4 is held between the pair of columnar portions 32*a* via a covering member 6. That is, since the sound pickup sensor 4 is disposed in the space S1 surrounded by the side plates 31, the upper plate 32, the lower plate 33, and the front plate 34, the sound pickup sensor 4 can be protected by the side plates 31, the upper plate 32, the lower plate 33, and the front plate 34 even if the sensor attaching part 3 receives impact from the outside.

In this case, a plurality of slits 34*a* (see FIG. 2, the number is 3 in the present embodiment) for communicating the outside on the front side (the side of the striking surface 102*a*) with the space S1 are formed on the front plate 34 located on the front side of the sound pickup sensor 4. Thus, the performance sound generated by the striking on the striking surface 102*a* is transmitted to the sound pickup sensor 4 via the slits 34*a*.

In this case, the sound pickup sensor 4 is configured as a directional (unidirectional) microphone and is arranged in a posture that directs the directional axis toward the front side. Therefore, in the fastening state, the directional axis of the sound pickup sensor 4 is directed toward the center side of the striking surface 102*a* (parallel to the striking surface 102*a*). As a result, the performance sound transmitted via the slits 34*a* is easily picked up by the sound pickup sensor 4.

On the other hand, since the side plate 31 located on the lateral side of the sound pickup sensor 4 has slits 31*a* that communicate the outside on the lateral side with the space S1 and extend from the front side with respect to the sound pickup sensor 4 to the back side, the vibration (sound) from the lateral side of the sound pickup sensor 4 is transmitted to both the front part and the back part of the sound pickup sensor 4 via the slits 31*a*.

Since the sound pickup sensor 4 is configured as a directional microphone, the vibration transmitted to both the front part and the back part of the sound pickup sensor 4 is canceled out by each other. Therefore, it is possible to prevent the detection signal caused by the vibration (for example, the performance sound of another percussion instrument) transmitted from the lateral side of the sound pickup sensor 4 from being outputted from the sound pickup sensor 4.

In addition, since the sound pickup sensor 4 is on the front end side of the sensor attaching part 3 and is disposed on the center side of the striking surface 102*a* with respect to the striking surface sensor 5 in the fastening state, when the striking surface 102*a* is struck, the performance sound generated near the center of the striking surface 102*a* is more likely to be picked up by the sound pickup sensor 4.

The covering member 6 is a substantially annular rubbery elastic body that covers the outer circumferential surface (the surface around the directional axis) of the sound pickup sensor 4, and a recess 6*a* is formed on the outer circumferential surface of the covering member 6 (see FIG. 2). The recess 6*a* is a recessed groove extending around the directional axis of the sound pickup sensor 4, and the recess 6*a* is engaged with protrusions 32*b* of the pair of columnar portions 32*a* (see FIG. 1(*b*)).

The protrusions 32*b* are rib-like projections extending vertically on the surfaces on the center side in the opposing direction of the pair of columnar portions 32*a*, and are formed on the pair of columnar portions 32*a* respectively. The opposing distance between the pair of protrusions 32*b* is set slightly smaller than (or the same as) the diameter of the groove bottom surface of the recess 6*a*. Thus, by fitting the covering member 6 between the pair of protrusions 32*b*, the recess 6*a* of the covering member 6 and the protrusions 32*b* of the upper plate 32 are engaged with each other. Since the sound pickup sensor 4 can be fixed between the upper plate 32 and the lower plate 33 through engagement between the recess 6*a* and the protrusions 32*b*, the sound pickup sensor 4 can be easily fixed to the sensor attaching part 3 via an elastic member (covering member 6).

A sensor plate P is disposed on the upper surface side of the lower plate 33, and the lower plate 33 and the sensor plate are fastened together to the columnar portions 32*a* by bolts (not shown). That is, by removing the lower plate 33 (sensor plate P) from the upper plate 32, the sound pickup sensor 4 can be removed from between the pair of columnar portions 32*a*. Since the columnar portions 32*a* can serve to fix the lower plate 33 (sensor plate P) to the upper plate 32 and to fix the sound pickup sensor 4 between the upper plate 32 and the lower plate 33, the number of parts can be reduced and the product cost of the sound pickup device 1 can be reduced.

In a part of the region on the lower surface side of the sensor plate P, a circular through hole 33*a* is formed in the lower plate 33 (see FIG. 2), and the striking surface sensor 5 is disposed on the lower surface of the sensor plate P located on the inner circumferential side of the through hole 33*a*.

The striking surface sensor 5 includes a disc-like double-sided tape 50 adhered to the lower surface of the sensor plate P and having cushioning properties, a disc-like piezoelectric element 51 adhered to the lower surface of the double-sided tape 50, and a truncated conical cushioning material 52 formed by a sponge and adhered to the lower surface of the piezoelectric element 51.

The striking surface sensor 5 is disposed opposite to the striking surface 102*a* in the fastening state, and the lower end of the cushioning material 52 is in contact with the striking surface 102*a*. The vibration of the striking surface 102*a* is transmitted to the piezoelectric element 51 via the cushioning material 52 (the vibration is detected by the piezoelectric element 51). That is, the striking surface sensor 5 is a contact sensor which directly detects the vibration of the striking surface 102*a* itself, and the vibration generated when the striking surface 102*a* is struck is also transmitted to the sensor plate P via the striking surface sensor 5. In this case, since the striking surface sensor 5 is attached to the sensor plate P located on the back side with respect to the sound pickup sensor 4, it is possible to dispose the sound pickup sensor 4 at a position separated from the striking surface sensor 5 by a predetermined distance in the front-back direction.

Thus, as compared with the case where the striking surface sensor 5 and the sound pickup sensor 4 are disposed one above the other with the sensor plate P in between, for example, the vibration transmission path from the striking surface sensor 5 to the sound pickup sensor 4 can be lengthened. Therefore, even if the sound pickup sensor 4 is disposed on the upper surface of the sensor plate P (the sensor plate P is fixed to the columnar portions 32*a* where the sound pickup sensor 4 is held), it is still possible to prevent the vibration generated when the striking surface 102*a* is struck from being transmitted to the sound pickup sensor 4 via the striking surface sensor 5, so it is possible to prevent the directional axis of the sound pickup sensor 4 from wobbling.

Moreover, since the vibration transmitted to the sound pickup sensor 4 via the sensor plate P and the columnar portions 32*a* is attenuated by the covering member 6 made of a rubbery elastic body that covers the outer circumference of the sound pickup sensor 4, wobbling of the directional axis of the sound pickup sensor 4 can be prevented more effectively. By preventing wobbling of the directional axis of the sound pickup sensor 4 in this manner, the performance sound generated when the striking surface 102*a* is struck is more likely to be picked up by the sound pickup sensor 4.

The space S1 in which the sound pickup sensor 4 is disposed communicates with a space S2 inside the body part 2. The space S2 is a space extending vertically in the body part 2, and a space having an L shape in the side view is formed inside the sound pickup device 1 by the space S1 and the space S2.

The space S2 is a space surrounded by a pair of side plates 21, an upper plate 22, a lower plate 23, a front plate 24, and a back plate 25 of the body part 2. The side plate 21 of the body part 2 is configured as the same part as the side plate 31 of the sensor attaching part 3, the upper plate 22 is configured as the same part as the upper plate 32, and a part of the front plate 24 is configured as the same part as the lower plate 33, but different reference numerals are used to describing the plates at the side of the body part 2 and the side of the sensor attaching part 3 respectively.

A vibration sensor 7 attached to the back plate 25, a sensor board 8 for inputting the signals from the vibration sensor 7 and the striking surface sensor 5, a main board 9 for performing various processes based on the signals outputted from the sensor board 8 and the sound pickup sensor 4, and an output board 10 for outputting the signal outputted from the main board 9 to the outside are disposed inside the space S1 and the space S2.

The vibration sensor 7 is a sensor for canceling the noise detected by the striking surface sensor 5 and is disposed on the upper end side (a position facing the space S1) of the back plate 25. The vibration sensor 7 includes an annular double-sided tape 70 adhered to the front surface of the back plate 25 and having cushioning properties, and a disc-like piezoelectric element 71 adhered to the front surface of the double-sided tape 70.

The inner diameter of the double-sided tape 70 is set smaller than the outer diameter of the piezoelectric element 71 and the outer diameter of the double-sided tape 70 is set larger than the outer diameter of the piezoelectric element 71. Since the outer edge of the piezoelectric element 71 is supported by the annular double-sided tape 70 over the entire circumference, when vibration is transmitted to the vibration sensor 7, the center side of the piezoelectric element 71 deforms to bend with the inner edge of the double-sided tape 70 as a fulcrum.

On the other hand, since the outer diameter of the double-sided tape 50 of the striking surface sensor 5 is set smaller than the outer diameter of the piezoelectric element 51, when vibration is transmitted to the striking surface sensor 5, the outer edge side of the piezoelectric element 51 deforms to bend with the outer edge of the double-sided tape 50 as a fulcrum. As compared with the striking surface sensor 5, the piezoelectric element 71 of the vibration sensor 7 is difficult to be bent by vibration at a low frequency. Thus, vibration at a relatively high frequency is more likely to be detected by the vibration sensor 7 than the vibration detected by the striking surface sensor 5.

Thus, when the vibration sensor 7 detects vibration, it can be determined that the vibration is vibration from the surroundings (for example, the performance sound of another instrument) that has a higher frequency than the vibration generated by the striking on the striking surface 102*a*. That is, when both the striking surface sensor 5 and the vibration sensor 7 detect vibration, it can be determined that the vibration detected by the striking surface sensor 5 is transmitted from the surroundings of the drum 100, so the vibration can be treated as noise.

Since the vibration sensor 7 is attached to the vertically extending back plate 25 of the body part 2, in the fastening state, the plate thickness direction of the piezoelectric element 71 is substantially parallel to the striking surface 102*a*. As a result, while the piezoelectric element 71 is easy to be bent by vibration in the horizontal direction, it is relatively difficult to be bent by vibration in the up-down direction. Therefore, even if the sound pickup device 1 vibrates vertically due to striking on the striking surface 102*a*, the piezoelectric element 71 can be prevented from detecting the vibration.

In addition, since the vibration sensor 7 is attached to the back plate 25 that is disposed at a position farthest from the striking surface 102*a* in the front-back direction, the distance from the striking surface 102*a* to the vibration sensor 7 can be lengthened. Therefore, it is possible to prevent the vibration generated by the striking on the striking surface 102*a* from being detected by the piezoelectric element 71. By preventing the vibration generated by the striking on the striking surface 102*a* from being detected by the piezoelectric element 71 in this manner, it is possible to prevent the vibration generated by the striking on the striking surface 102*a* from being treated as noise.

The striking surface sensor 5 and the vibration sensor 7 are electrically connected to the sensor board 8, and the sound pickup sensor 4 and the sensor board 8 are electrically connected to the main board 9. The main board 9 is provided with a sound generator and a CPU. Generation of a musical sound signal based on the signal from the sensor board 8, processing of noise determination, and the like are performed by the main board 9. The main board 9 is electrically connected to the output board 10, and the musical sound signal (electronic sound) and the sound pickup signal (microphone sound) outputted from the main board 9 are outputted to the outside via the output board 10.

A first terminal 21*a* and a second terminal 21*b* for outputting an electronic sound and a microphone sound to the outside, a selection part 21*c* for selecting whether to output a mixing signal mixed with the electronic sound and the microphone sound, an adjustment part 21*d* for adjusting the volumes of the electronic sound and the microphone sound outputted from the first terminal 21*a* and the second terminal 21*b*, a power supply switch 21*e* for switching ON and OFF the power supply of the sound pickup device 1, and a connection part 21*f* for connecting an AC adapter are provided on the outer surface of the side plate 21 of the body part 2 (see FIG. 1(*a*)).

A microphone sound based on the detection result of the sound pickup sensor 4 is outputted from the first terminal 21*a*, and an electronic sound based on the detection result of the striking surface sensor 5 is outputted solely or mixed with the microphone sound and outputted from the second terminal 21*b*.

The connection part 21*f* is a part for operating the sound pickup device 1 by the commercial power supply. In the present embodiment, however, the sound pickup device 1 can also be operated by a battery B (dry battery in the present embodiment) (see FIG. 2). The battery B is housed in a housing part 26 that is recessed from the front surface (front plate 24) of the body part 2 toward the back side, and the front plate 24 is provided with a lid part 24*a* to open and close the housing part 26.

When using the sound pickup device 1, a jack of a cable for connecting an external device (for example, effector or speaker) is connected to the first terminal 21*a* or the second terminal 21*b*. In this case, a predetermined moment acts on the fastening position due to pulling of the cable or rocking of the cable caused by vibration during performance.

On the other hand, in the present embodiment, the first terminal 21*a* and the second terminal 21*b* are disposed on the upper side with respect to the center of the body part 2 in the up-down direction (above the housing part 26). Therefore, the first terminal 21*a* and the second terminal 21*b* can be brought close to the fastening position (fulcrum). As a result, the moment acting on the fastening position can be reduced even if a load is applied to the first terminal 21*a* or the second terminal 21*b* via the cable.

Further, since the housing part 26 that houses the battery B is formed on the side of the front plate 24 (on the front side with respect to the center of the body part 2 in the front-back direction), the centroid position of the battery B can be brought close to the front side of the body part 2, that is, the fastening position (fulcrum). Therefore, the moment acting on the fastening position can be reduced even when the battery B is housed in the body part 2.

By reducing the moment acting on the fastening position in this manner, the sound pickup device 1 can be stably fixed to the hoop 103 of the drum 100. Thereby, it is possible to prevent the sensor attaching part 3 from rotating around the fastening position (fulcrum) and causing the directional axis of the sound pickup sensor 4 to wobble, or prevent the striking surface sensor 5 from moving away from the striking surface 102*a*. Thus, the performance sound generated by the vibration of the striking surface 102*a* or the vibration of the striking surface 102*a* can be accurately detected by the sound pickup sensor 4 and the striking surface sensor 5.

Figure 3:
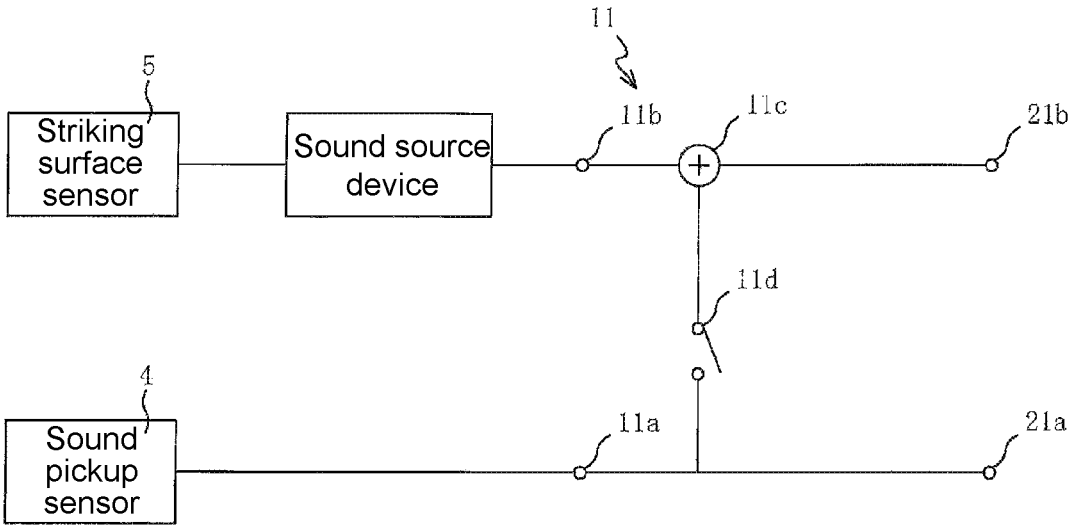
FIG. 3 is a block diagram conceptually showing an output method of a musical sound signal and a sound pickup signal performed by the sound pickup device.

Next, an output method for the sound pickup device 1 to output the musical sound signal and the sound pickup signal will be described with reference to FIG. 3. FIG. 3 is a block diagram conceptually showing the output method of the musical sound signal and the sound pickup signal performed by the sound pickup device 1.

As shown in FIG. 3, the sound pickup sensor 4 is connected to an output circuit 11, and the striking surface sensor 5 is connected to the output circuit 11 via a sound generator. The output circuit 11 is a circuit for outputting a microphone sound and an electronic sound to the first terminal 21*a* and the second terminal 21*b* (see FIG. 1(*a*)) and is provided in the output board 10 (see FIG. 2).

The output circuit 11 includes a first input part 11*a* for inputting the microphone sound based on the detection result of the sound pickup sensor 4, a second input part 11*b* for inputting the electronic sound generated by the sound generator based on the detection result of the striking surface sensor 5, a mixing circuit 11*c* for mixing the microphone sound inputted to the first input part 11*a* and the electronic sound inputted to the second input part 11*b*, and a switch 11*d* for selecting whether to output a mixing signal mixed with the microphone sound and the electronic sound by the mixing circuit 11*c*. Since the mixing circuit 11*c* may adopt the conventional configuration that includes a resistor and an operational amplifier, a detailed description thereof will be omitted.

When the striking surface sensor 5 detects vibration of the striking surface 102*a* (detecting process), an electronic sound is generated in the sound generator based on the detection result (signal generating process). At this time, by turning off (selecting process) the switch 11*d* (selection means), it is possible to output only the electronic sound generated by the sound generator to the outside from the second terminal 21*b* via the second input part 11*b* and the mixing circuit 11*c* (first output means).

When the sound pickup sensor 4 detects (picks up) the performance sound generated by the vibration of the striking surface 102*a* (detecting process), a sound pickup signal is generated based on the detection result (signal generating process). At this time, by turning off the switch 11*d* (selecting process), it is possible to output only the microphone sound to the outside from the first terminal 21*a* via the first input part 11*a* (second output means).

In the case of outputting a mixing signal mixed with the microphone sound and the electronic sound, by turning on the switch 11*d* (selecting process), the microphone sound is mixed with the electronic sound by the mixing circuit 11*c*, and the mixed signal is outputted from the second terminal 21*b* to the outside (third output means).

That is, the sound pickup device 1 includes the first output means for outputting only the electronic sound, the second output means for outputting only the microphone sound, the third output means for mixing the electronic sound and the microphone sound for output, and the selection means for selecting at least one of the first output means, the second output means, and the third output means for output in one case (the body part 2 and the sensor attaching part 3). Therefore, variations of musical sound generation performed by the sound pickup device 1 can be increased.

Figure 4A:
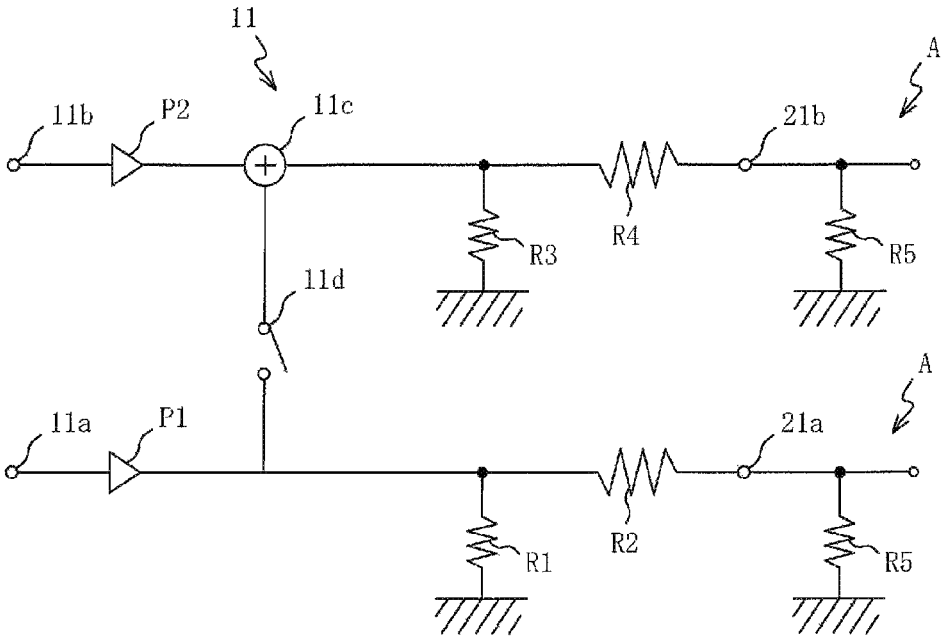
FIG. 4(*a*) and FIG. 4(*b*) are circuit diagrams schematically showing the output circuit of the sound pickup device.
Figure 4B:
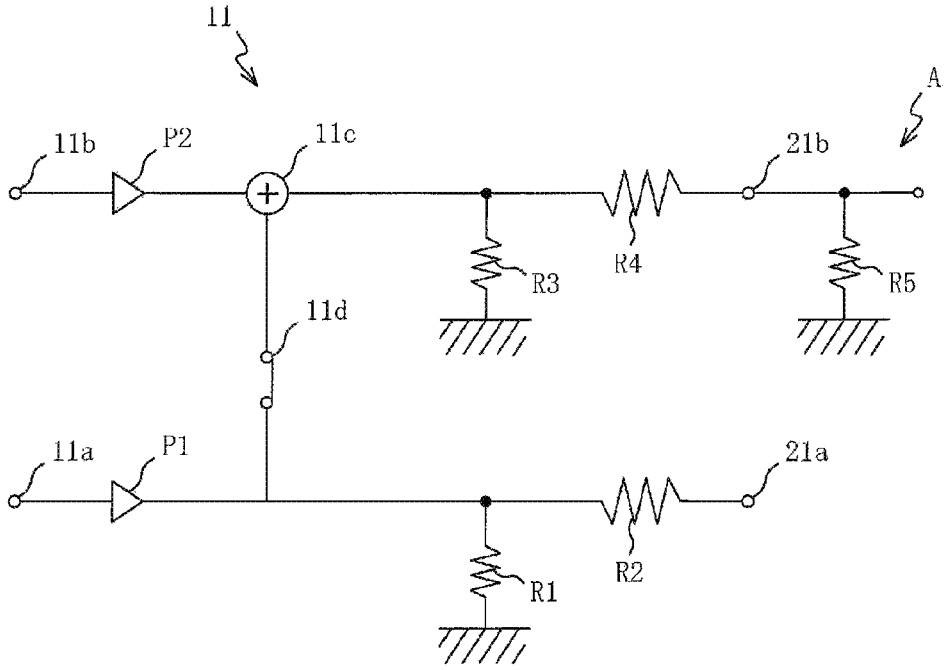

Next, the detailed configuration of the output circuit 11 will be described with reference to FIG. 4(*a*) and FIG. 4(*b*). FIG. 4(*a*) and FIG. 4(*b*) are circuit diagrams schematically showing the output circuit 11 of the sound pickup device 1. FIG. 4(*a*) illustrates a state where the switch 11*d* is turned off and an external device A is connected to the first terminal 21*a* and the second terminal 21*b*, respectively (a microphone sound is outputted solely to the external device A connected to the first terminal 21*a* and an electronic sound is outputted solely to the external device A connected to the second terminal 21*b*). On the other hand, FIG. 4(*b*) illustrates a state where the switch 11*d* is turned on and the external device A is connected to the second terminal 21*b* (the microphone sound and the electronic sound are mixed and outputted to the external device A connected to the second terminal 21*b*).

As shown in FIG. 4(*a*) and FIG. 4(*b*), one end of a preamplifier P1 is connected to the first input part 11*a*, and the microphone sound is amplified to a predetermined level by the preamplifier P1. One end of a resistor R1 is connected to the other end of the preamplifier P1, and the other end of the resistor R1 is grounded. One end of a resistor R2 is connected to one end of the resistor R1 and the other end of the resistor R2 is connected to the first terminal 21*a*.

The resistor R1 is configured as a ground resistor for stabilizing the potential applied to a signal line between the first input part 11*a* and the first terminal 21*a* in a state where no microphone sound is outputted to the signal line between the first input part 11*a* and the first terminal 21*a*. Further, the resistor R2 is configured as a protection resistor for suppressing an excessive current from flowing to the output circuit 11 when the external device A (for example, effector or speaker) connected to the first terminal 21*a* is short-circuited.

One end of a preamplifier P2 is connected to the second input part 11*b*, and the electronic sound is amplified to a predetermined level by the preamplifier P2. One end of a resistor R3 is connected to the other end of the preamplifier P2 via the mixing circuit 11*c*, and the other end of the resistor R3 is grounded.

One end of a resistor R4 is connected to one end of the resistor R3 and the other end of the resistor R4 is connected to the second terminal 21*b*. The resistor R3 is configured as a ground resistor for stabilizing the potential applied to a signal line between the second input part 11*b* and the second terminal 21*b* in a state where no electronic sound or microphone sound is outputted to the signal line between the second input part 11*b* and the second terminal 21*b*. Further, the resistor R4 is configured as a protection resistor for suppressing an excessive current from flowing to the output circuit 11 when the external device A connected to the second terminal 21*b* is short-circuited.

One end of the switch 11*d* is connected to the mixing circuit 11*c*, and the other end of the switch 11*d* is connected between the preamplifier P1 and the resistor R1. The connection state between the preamplifier P1 and the mixing circuit 11*c* by the switch 11*d* is switchable through the operation of the selection part 21*c* (see FIG. 1(*a*)).

By connecting the preamplifier P1 to the mixing circuit 11*c* through the operation of the selection part 21*c* (see FIG. 4(*b*)), the microphone sound outputted from the preamplifier P1 can be directly mixed with the electronic sound outputted from the preamplifier P2.

The "directly mixing" means that the microphone sound is substantially directly mixed with the electronic sound not via other elements, except for those required for mixing the electronic sound and the microphone sound (for example, elements such as resistors and operational amplifiers provided in the mixing circuit 11*c*).

Figure 5A:
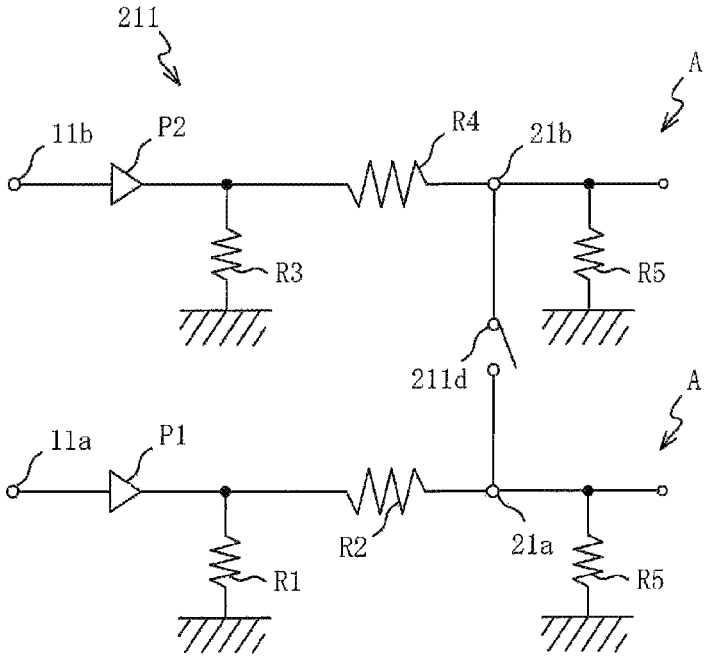
FIG. 5(*a*) and FIG. 5(*b*) are circuit diagrams schematically showing the output circuit according to another example.
Figure 5B:
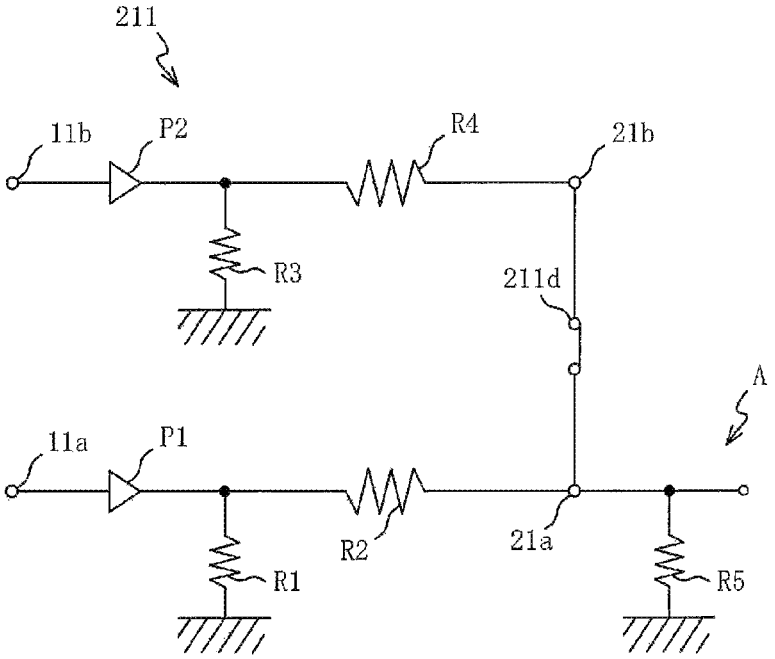

Here, an output circuit 211 according to another example for mixing the microphone sound and the electronic sound on the downstream side of the resistors R1 to R4 will be described with reference to FIG. 5(*a*) and FIG. 5(*b*). FIG. 5(*a*) and FIG. 5(*b*) are circuit diagrams schematically showing the output circuit 211 according to another example. FIG. 5(*a*) illustrates a state where the switch 211*d* is turned off and the external device A is connected to the first terminal 21*a* and the second terminal 21*b*, respectively (the microphone sound is outputted solely to the external device A connected to the first terminal 21*a* and the electronic sound is outputted solely to the external device A connected to the second terminal 21*b*). On the other hand, FIG. 5(*b*) illustrates a state where the switch 211*d* is turned on and the external device A is connected to the first terminal 21*a* (the microphone sound and the electronic sound are mixed and outputted to the external device A connected to the first terminal 21*a*).

As shown in FIG. 5(*a*) and FIG. 5(*b*), the output circuit 211 according to another example has the same configuration as the output circuit 11 of the present embodiment except that the switch 211*d* is disposed at a different position. Thus, parts the same as those of the output circuit 11 of the present embodiment are denoted by the same reference numerals and descriptions thereof are omitted.

Two ends of the switch 211*d* of the output circuit 211 according to another example are connected to the first terminal 21*a* and the second terminal 21*b*. For example, when the switch 211*d* is in the off state (the state in FIG. 5(*a*)), only the electronic sound is outputted to the external device A connected to the second terminal 21*b*.

In the case where only the electronic sound is outputted, if the load (input impedance) on the side of the external device A is set as a resistor R5, the combined resistor from the preamplifier P2 to the external device A (for ease of understanding, a combined resistor excluding the resistor R3) is (R4+R5), and the electronic sound outputted from the second terminal 21*b* is R5/(R4+R5) times the electronic sound outputted from the preamplifier P2.

More specifically, if the resistor R4 is set to 1 kΩ and the resistor R5 is set to 10 kΩ, the electronic sound outputted from the second terminal 21*b* is about 0.91 times the electronic sound outputted from the preamplifier P2.

On the other hand, if the switch 211*d* is in the on state (the state in FIG. 5(*b*)), the electronic sound is mixed with the microphone sound and outputted to the external device A connected to the first terminal 21*a*. When the electronic sound is mixed with the microphone sound and outputted, a combined resistor Rs from the first terminal 21*a* to the ground is (R1+R2)×R5/(R1+R2+R5). Because the electronic sound outputted from the preamplifier P2 is affected by the combined resistor Rs (the resistor R1 and the resistor R2 act in parallel), the electronic sound outputted from the first terminal 21*a* is Rs/(R4+Rs) times the electronic sound outputted from the preamplifier P2.

More specifically, if the resistor R1 is set to 10 kΩ and the resistor R2 is set to 1 kΩ, the electronic sound outputted from the first terminal 21*a* is 0.84 times the electronic sound outputted from the preamplifier P2. Therefore, as compared with the case where only the electronic sound is outputted from the second terminal 21*b*, the output of the electronic sound when the microphone sound is mixed decreases.

In contrast thereto, in the output circuit 11 (see FIG. 4(*a*) and FIG. 4(*b*)) of the present embodiment, the microphone sound outputted from the preamplifier P1 and the electronic sound outputted from the preamplifier P2 are mixed on the upstream side of the resistors R1 to R4, which can solve the problem in the output circuit 211 of another example. The problem is that the output circuit 211 is effected by the resistors R1 to R4 on the upstream side of where the microphone sound and the electronic sound are mixed. Therefore, when the electronic sound and the microphone sound are mixed for output, it is possible to prevent the output of the electronic sound from decreasing.

Although the disclosure has been described based on the above embodiment, the disclosure should not be construed as being limited to the above embodiment, and it can easily be inferred that various improvements and modifications can be made without departing from the spirit of the disclosure.

Although the above embodiment illustrates that the sound pickup sensor 4 is configured using a directional microphone, the disclosure is not limited thereto. The sound pickup sensor may be configured using sensors other than a microphone (for example, piezoelectric element, magnet pickup, and the like), for example.

Although the above embodiment illustrates that the directional axis of the sound pickup sensor 4 is directed parallel to the striking surface 102*a* in the fastening state, the disclosure is not limited thereto. For example, the sound pickup sensor 4 may be disposed to be inclined with respect to the striking surface 102*a*, and the directional axis of the sound pickup sensor 4 may be directed to the center of the striking surface 102*a*. As a result, the performance sound generated by the striking surface 102*a* is more likely to be picked up by the sound pickup sensor 4.

Although the above embodiment illustrates that the slits 31*a* extend from the front side to the back side of the sound pickup sensor 4, the disclosure is not limited thereto. For example, a plurality of through holes may be formed in the side plate 31 respectively on the front side and the back side of the sound pickup sensor 4.

Although the above embodiment illustrates that the striking surface sensor 5 is configured as a sensor including the piezoelectric element 51, the disclosure is not limited thereto. For example, a pressure sensor, an electrostatic sensor, a laser sensor, or a magnet sensor may be used as the striking surface sensor.

Although the above embodiment illustrates that the sound pickup sensor 4 is disposed on the front end side of the sensor attaching part 3 with respect to the striking surface sensor 5, the disclosure is not limited thereto. For example, the sound pickup sensor 4 and the striking surface sensor 5 may be disposed one above the other with the sensor plate P in between, or the sound pickup sensor 4 and the striking surface sensor 5 may be arranged at a predetermined interval in the left-right direction.

Although the above embodiment illustrates that the covering member 6 is formed with the recess 6*a* and the columnar portions 32*a* of the upper plate 32 are formed with the protrusions 32*b*, the disclosure is not limited thereto. For example, a protrusion may be formed on the covering member 6 and recesses may be formed in the columnar portions 32*a* of the upper plate 32 to be engaged with the protrusion. In addition, recesses or protrusions may be formed on the inner surfaces of the pair of side plates 31 or recesses or protrusions may be formed on the inner surfaces of the upper plate 32 and the lower plate 33 to be engaged with the recesses or protrusions of the covering member 6.

Although the above embodiment illustrates the configuration that the plate thickness direction of the piezoelectric element 71 is substantially parallel to the striking surface 102*a* in the fastening state (the piezoelectric element 71 is disposed vertically with respect to the striking surface 102*a*), the disclosure is not limited thereto. For example, at least the piezoelectric element 71 is inclined by 45° or more with respect to the striking surface 102*a*, which makes it possible to prevent the vibration of the striking surface 102*a* from being detected by the piezoelectric element 71. Further, the piezoelectric element 71 is inclined by 60° or more with respect to the striking surface 102*a*, which can more effectively prevent the vibration of the striking surface 102*a* from being detected by the piezoelectric element 71. Moreover, the vibration sensor 7 may be disposed on the side plate 21 or the upper plate 22 of the body part 2.

Although the above embodiment illustrates that the first terminal 21*a* and the second terminal 21*b* are disposed on the upper side with respect to the center of the body part 2 in the up-down direction (above the housing part 26), the disclosure is not limited thereto. For example, the first terminal 21*a* and the second terminal 21*b* may be disposed below the center of the body part 2 in the up-down direction. The first terminal 21*a* and the second terminal 21*b* may also be disposed on the back plate 25 of the body part 2.

Although the above embodiment illustrates that the housing part 26 is provided on the front side of the body part 2, the disclosure is not limited thereto. For example, the housing part 26 may be provided on the side of the back plate 25 of the body part 2.

Although the above embodiment illustrates that the main board 9 includes a sound generator, the disclosure is not limited thereto. For example, the sound generator may be configured separately from the sound pickup device 1. That is, only the signal detected by the sound pickup sensor 4 or the striking surface sensor 5 is outputted to the external sound generator, and generation of a musical sound signal and mixing of the sound pickup signal and the musical sound signal are performed by the external sound generator.

Although the above embodiment illustrates that the mixing circuit 11*c* of the output circuit 11 is provided on the signal line on the side of the second input part 11*b*, the disclosure is not limited thereto. For example, the mixing circuit 11*c* may be provided on the signal line on the side of the first input part 11*a*, so as to mix the electronic sound with the microphone sound.

The above embodiment does not specify what kind of musical sound signal is generated by the sound generator based on the detection result of the striking surface sensor 5. For example, the musical sound signal generated by the sound generator may be a musical sound related to the actual performance sound (raw sound) generated by the vibration of the striking surface 102*a*, or a musical sound not related to the actual performance sound. In the former case, a sound for enhancing the attack sound or the bass sound can be added to the raw sound for output. In the latter case, a sound of tambourine or hand claps (clapping) can be superimposed on the raw sound of the drum for output.

What is claimed is:

1. A sound pickup device, installed on an outer edge of a drum having a drum head, comprising:

one case fixed to the outer edge of the drum;

a first output means, in contact with the drum head, detecting vibration of the drum head of the drum, generating a musical sound signal based on the detected vibration, and outputting the musical sound signal;

a second output means, which is a microphone, detecting a performance sound generated by the vibration of the drum head without contacting the drum head, generating a sound pickup signal based on the detected performance sound, and outputting the sound pickup signal;

a third output means mixing the musical sound signal and the sound pickup signal outputted from the first output means and the second output means for output;

a selection means selecting at least one of the first output means, the second output means, and the third output means for output; and a housing part housing a battery, wherein the first output means, the second output means, the third output means, and the housing part are disposed in the one case.

2. The sound pickup device according to claim 1, wherein the first output means comprises a sound generator that generates the musical sound signal based on the detected vibration, and the sound generator is disposed in the one case.

3. The sound pickup device according to claim 1, comprising a clamp part for fastening a hoop of the drum, wherein the one case comprises a hang down portion that hangs down below a fastening position of the clamp part from a rear end of the clamp part, and the housing part is disposed in the hang down portion at a side close to the clamp part.

4. The sound pickup device according to claim 1, wherein the microphone is configured using a directional microphone and is disposed with a directional axis directed to the center of the drum head.

5. The sound pickup device according to claim 1, wherein the first output means comprises a cushioning material to cushion the vibration of the drum head.

6. A sound pickup device, installed on an outer edge of a drum having a striking surface, comprising:

a sensor attaching part extending to a center of the striking surface of the drum;

a striking surface sensor in contact with the striking surface and attached to the sensor attaching part to detect vibration of the striking surface;

a sound pickup sensor, which is a microphone, attached to the sensor attaching part and picking up a performance sound generated by the vibration of the striking surface without contacting the striking surface; and an output circuit outputting a musical sound signal generated based on a detection result of the striking surface sensor and a sound pickup signal outputted from the sound pickup sensor respectively to outside, wherein the sensor attaching part protrudes to the center of striking surface of the drum, and the sound pickup sensor and the striking surface sensor are attached to a protruding front end side of the sensor attaching part.

7. The sound pickup device according to claim 6, wherein the output circuit comprises a mixing circuit mixing the musical sound signal and the sound pickup signal, and a selection circuit selecting whether to output the musical sound signal and the sound pickup signal individually or to output a mixing signal mixed with the musical sound signal and the sound pickup signal.

8. The sound pickup device according to claim 7, comprising a sound generator generating the musical sound signal based on the detection result of the striking surface sensor, wherein the output circuit comprises a first preamplifier amplifying the sound pickup signal outputted from the sound pickup sensor, a first terminal connected to the first preamplifier and outputting the sound pickup signal to the outside, a second preamplifier amplifying the musical sound signal outputted from the sound generator, and a second terminal connected to the second preamplifier and outputting the musical sound signal to the outside.

9. The sound pickup device according to claim 8, wherein ground resistors for stabilizing a potential of a signal line is disposed respectively between the first preamplifier and the first terminal and between the second preamplifier and the second terminal.

10. The sound pickup device according to claim 9, wherein protection resistors for protecting the output circuit from overcurrent is disposed respectively between the first preamplifier and the first terminal and between the second preamplifier and the second terminal.

11. The sound pickup device according to claim 10, wherein the mixing circuit mixes the sound pickup signal outputted from the first preamplifier and the musical sound signal outputted from the second preamplifier on an upstream side of the ground resistors and the protection resistors.

12. The sound pickup device according to claim 8, comprising:

a clamp part for fastening the outer edge of the drum that has a hoop;

a body part having a housing part that houses a battery and hanging down below the clamp part from a rear end of the clamp part of the sensor attaching part, and the housing part is disposed on a front side of the body part.

13. The sound pickup device according to claim 12, wherein the body part comprises a back plate, a vibration sensor is disposed on the back plate, the vibration sensor is configured by adhering a piezoelectric element to the back plate with an annular adhesive member, and an inner diameter of the adhesive member is smaller than an outer diameter of the piezoelectric element and an outer diameter of the adhesive member is larger than the outer diameter of the piezoelectric element.

14. The sound pickup device according to claim 12, wherein the first terminal and the second terminal are disposed on the body part above the housing part.

15. The sound pickup device according to claim 6, wherein the sound pickup sensor is disposed closer to the center of the striking surface than the striking surface sensor.

16. The sound pickup device according to claim 6, wherein the sound pickup sensor is configured using a directional microphone and is disposed with a directional axis directed to the center of the striking surface.

17. The sound pickup device according to claim 16, comprising a covering member formed using a rubbery elastic body and covering an outer circumferential surface of the sound pickup sensor around the directional axis, wherein the covering member comprises a protruding or recessed engaging part formed on an outer circumferential surface of the covering member, and the sensor attaching part comprises a recessed or protruding engaged part to be engaged with the engaging part in a manner of holding the engaging part.

18. The sound pickup device according to claim 6, wherein the sensor attaching part comprises a pair of side plates opposite to each other, an upper plate connecting upper ends of the pair of side plates, a lower plate disposed opposite to a lower side of the upper plate, and a front plate shielding a front end of a space surrounded by the side plates, the upper plate, and the lower plate.

19. The sound pickup device according to claim 18, wherein the pair of side plates has slits that communicate the outside on a lateral side of the side plates with the space and extend from a front side to a back side with respect to the sound pickup sensor.

20. An output method for a sound pickup device, comprising:

a first detecting process of detecting vibration of a striking surface of a drum by contacting the striking surface;

a second detection process of detecting a performance sound generated by the vibration of the striking surface by using a microphone without contacting the striking surface;

a first signal generating process of generating a musical sound signal based on detection results obtained in the first detecting process;

a second signal generating process of generating a sound pickup signal based on detection results obtained in the second detecting process; and a selecting process of selecting whether to output the musical sound signal and the sound pickup signal generated by the signal generating process individually, or to output a mixing signal mixed with the musical sound signal and the sound pickup signal, wherein the microphone is configured using a directional microphone and is disposed with a directional axis directed to the center of the striking surface.

21. The output method for the sound pickup device according to claim 20, wherein the first detecting process, the second detecting process, the first signal generating process, the second signal generating process, and the selecting process are executed in one case.

* * * * *